US005190301A

United States Patent [19]

Malewicz

[11] Patent Number: 5,190,301

[45] Date of Patent: Mar. 2, 1993

[54] FASTENING SYSTEM FOR THE WHEELS OF AN IN-LINE ROLLER SKATE

[75] Inventor: Andrzej M. Malewicz, Minnetonka, Minn.

[73] Assignee: Rollerblade, Inc., Minneapolis, Minn.

[21] Appl. No.: 668,612

[22] Filed: Mar. 13, 1991

[51] Int. Cl.[5] ..... A63C 17/06

[52] U.S. Cl. ..... 280/11.22; 280/11.27; 411/544; 411/956

[58] Field of Search ..... 411/154, 146, 166, 544, 411/956; 280/11.22, 11.23, 279, 288, 304.3, 11.27; 301/5.3, 5.7

[56] References Cited

U.S. PATENT DOCUMENTS

| | | | |
|---|---|---|---|
| 844,382 | 2/1907 | Mercer | 411/956 X |
| 1,857,139 | 5/1932 | Carlton | 411/166 X |
| 2,412,290 | 12/1946 | Rieske | 280/11.22 X |
| 2,783,810 | 3/1957 | Wrigley | 411/956 X |
| 3,880,441 | 4/1975 | Silver | 280/11.22 |
| 4,400,038 | 8/1983 | Hasokawa | 280/288 X |
| 4,909,523 | 3/1990 | Olson | 280/11.2 |
| 5,028,058 | 7/1991 | Olson | 280/11.22 X |
| 5,046,746 | 9/1991 | Gierveld | 280/11.22 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |

*Primary Examiner*—Margaret A. Focarino
*Assistant Examiner*—Michael Mar
*Attorney, Agent, or Firm*—Merchant, Gould, Smith, Edell, Welter & Schmidt

[57] ABSTRACT

The present invention provides a fastening system that is not subject to loosening and that is useful for attaching one member to another member. The invention provides an arrangement for mounting a wheel to an in-line roller skate and comprises mutually engagable undulating surface patterns disposed on a skate frame side rail and the bottom surface of the head of the wheel axle. The threaded fastener that is attached to the other end of the axle may also include a surface pattern that is mutually engagable with a surface pattern on the other side rail to provide locking engagement between the threaded fastener and the axle head on both sides of the skate frame.

44 Claims, 4 Drawing Sheets

FASTENING SYSTEM FOR THE WHEELS OF AN IN-LINE ROLLER SKATE

The present invention relates generally to a fastening system that is not subject to loosening and that is useful for attaching one object to another under conditions of substantial vibration and shock and particularly to such a fastening system as used for attaching a wheel to an in-line roller skate.

BACKGROUND OF THE PRESENT INVENTION

Skating on in-line or tandem roller skates is a fast-growing recreational activity. These skates usually include a synthetic boot and attached frame which rotatably mounts a wheel on each of a plurality of wheel axles that extend between a pair of parallel side rails. The side rails have opposed apertures through which each wheel axle extends. Each wheel axle usually has a bolt-like configuration and is inserted through the apertures of the side rails from one side thereof with the threaded end of the bolt extending beyond the other side rail. A nut is tightened onto the threaded end to attach the wheel securely to the skate.

It has been observed that even well tightened nuts and bolts used to attach the wheels to the frame of an in-line roller skate tend to loosen as a result of road vibration and shock forces imparted to the bolts and nuts during skating use. Such forces cause the tightened nuts and bolts to gradually loosen, and the nut, and in extreme cases the axle, may work free from the frame. Without regular inspections and tightening, such loosening can cause deteriorating skate performance and eventually pose safety problems for the skater.

It has been further observed that it can be somewhat difficult to determine when a nut has been tightened just the right amount to the threaded end of the axle. Failure to tighten the nut enough will result in its working loose more quickly than usual, while overtightening it can result in gouging damage to the frame as the nut is forced to cut into the frame side rail. Proper tightening is not a great problem during initial assembly of the skate by the manufacturer since torque wrenches can then be used to determine optimum tightening. It can, however, present a problem for the skater when rotating or replacing the wheels, or tightening a nut which has become loose, because a torque wrench will usually not be available.

A partial solution to these problems is to use a bolt in combination with a lockwasher/washer to reduce the tendency of the axle to loosen, but loosening does still occur. The lockwasher/washer combination does not remove the need for a torque wrench, and the extra washers and lockwashers do add extra weight and add additional parts to assemble and inventory. In addition, such parts are easily lost during wheel rotation or replacement and they add extra length to the axle and increase the risk of the more elongated axle scratching or gouging objects along the skater's path. Consequently, use of washers and lockwashers has not been a satisfactory solution.

It would be desirable to have a fastening system for assembling a wheel to the frame of an in-line roller skate so that the wheel is not subject to loosening during skating use. It would also be desirable to have a fastening system that would enable the assembler, in particular, the consumer, to determine without a torque wrench when the threaded fastener was properly tightened onto the threaded end of the axle, thus avoiding the correlative problems of overtightening of the wheel axle with its potential frame damage, and undertightening the axle with the risk of premature loosening of the wheel. The present invention provides a solution to these long existing problems.

SUMMARY OF THE PRESENT INVENTION

The invention comprises a new fastener and a fastener system that is not subject to loosening during operation of the object to which it is attached. The fastener comprises a bolt having a shaft including a threaded end at one end of the shaft and a bolt head disposed at the other end of the shaft. The bolt head has a lower surface on which is an undulating surface pattern. This pattern contacts the face of the article into which the bolt is inserted and the face of the article is provided with a matching undulating pattern which interacts with the pattern on the lower surface of the bolt head. The lower surface pattern preferably has a periodic configuration and is continuous, though non-continuous surfaces will suffice. The lower surface thus has a plurality of regularly alternating high and low areas. In a representative embodiment of the present invention, the configuration of the bolt head lower surface can be generally defined by a sine wave function such as:

$$f(\psi)=A\sin(n\psi+\phi),$$

where

A = amplitude of the wave;

n = the number of wave cycles around the annular surface, with $n \geqq 2$;

$\psi$ = the angular displacement around the annular surface of the bolt head; and $\phi$ = the phase angle.

More generally, the lower surface of the bolt head can be described by the following equation:

$$g(r, \psi+\phi)=A(r)B(\psi+\phi),$$

where $g(r, \psi+\phi)$ = a function dependent on r and $\psi$;

$A(r)$ = a function dependent on r, the radius from the center of the bolt shaft to the edge of the bolt head; and $B(\psi+\phi)$ = a function dependent on $\psi$, the angular displacement around the annular surface of the bolt head, where $\phi$ is the phase angle.

The article into which the bolt is inserted has a surface that contacts the undulating surface of the bolt head and includes an undulating surface of the same general configuration as the undulating surface of the bolt head. With such a configuration, the article's undulating surface and the bolt head undulating surface will matingly engage as the bolt is tightened. As the surfaces engage, slight deformations of the article will occur as the high areas of the two undulating surfaces encounter each other, depending on the particular materials out of which they are made, with the maximum deformation occurring at or near the engagement of the peaks of the high areas of the two engaging surfaces. As the engagement of the high areas begins, that is, as the leading flank of one high area engages the leading flank of a high area on the other surface, the deformations begin and increase as the respective peaks of the high areas of the two surfaces near each other. As the peaks pass one another, each peak will engage the trailing flank of the opposing high area and the deformation will decrease until each of the peaks encounter the low area on the other surface, at which time the deformation will have substantially ceased. There may, however, be some residual compression in the article or the bolt or both, again depending on the type of material used for these component parts.

The height of the various high areas should be sufficient so that the force necessary to turn the peaks of such areas past one another is generally in excess of those forces encountered by the fastener during operation of the skate. Thus the fastener will generally be inhibited from rotating, and thus loosening, once attached.

When used on an in-line roller skate, such as those manufactured by the assignee of the present invention, the fastener system will include a skate frame having a pair of longitudinally extending, substantially parallel, spaced apart side rails. Each side rail has at least one axle aperture configured to receive the bolt shaft. The frame includes a surface portion having a configuration conformable to that of the bottom side of the bolt head, as described generally above, and symmetrically disposed about the aperture. Where desirable to accommodate a multiply positionable bolt within a noncircular axle aperture, the fastening system may include a plug member having a lug conformable to the configuration of the axle aperture and having an axle bore eccentrically disposed relative to the lug such that the plug is insertable into the frame aperture in a plurality of positions, thereby placing the axle bore in a plurality of positions, and thus disposing the bolt in a plurality of positions with respect to the frame aperture. That portion of the frame side rail surface encountered by the underside of the bolt head may then be configured to present an undulating surface which engages the undulating surface of the bolt head such that the bolt will be constrained from rotation when tightened onto the threaded fastener.

Where the roller skate frame is interchangeable for use on left and right boots, both side rails of the frame can be configured with the undulating surface where the axle passes through the frame. Under these circumstances, a nut or other threaded fastener having a configuration similar to the lower surface of the bolt head may be used, and the undulating surface on the frame will prevent rotation of the threaded fastener. If desired, such a fastener may be used even if the frame is not interchangeable.

The foregoing objects of the invention will become apparent to those skilled in the art when the following detailed description of the invention is read in conjunction with the accompanying drawings and claims. Throughout the drawings, like numerals refer to similar or identical parts.

DESCRIPTION OF THE PREFERRED EMBODIMENT

Figure 1:
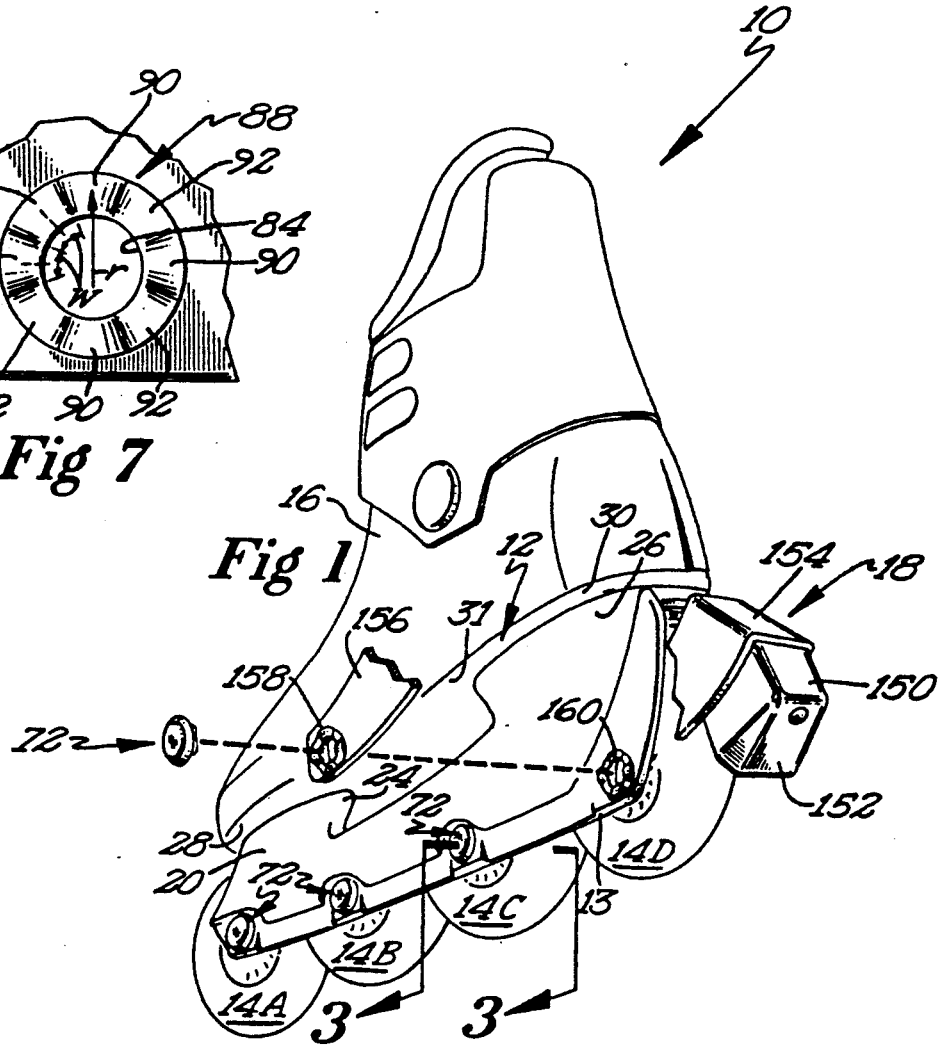
FIG. 1 illustrates an in-line roller skate having wheels fastened thereon according to the fastening system of the present invention and shows a partially broken-away brake assembly arm.

Referring now to FIG. 1, the present invention as embodied in an in-line roller skate 10 is shown. Skate 10 includes an elongated, light-weight, elastic frame 12 to which a plurality of substantially identical in-line skate wheels 14A, 14B, 14C and 14D are rotatably mounted for rotation in a common plane. The frame 12 is mounted to a boot 16 which provides protection and support to the foot and ankle of the skater and carries a brake assembly 18 at the rear thereof. While the shown boot 16 provides one type of attachment means for releasably securing the frame 12 to a skater, it should be understood that other boots, shoes, straps or clamps can be substituted, and are within the purview of the invention.

Frame 12 comprises longitudinally extending, parallel, spaced apart first and second side rails 20 and 22, each of which has laterally inwardly extending mounting brackets 24 and 26 at the front and rear of the frame and bears against the toe 28 and the heel 30, respectively of boot sole 31 of boot 16. Frame 12 may be securely attached to boot 16 by any known means, such as by riveting or bolting the two together. Frame 12 is preferably manufactured of a synthetic material such as glass filled nylon and may be manufactured in one or more pieces as desired.

Each side rail 20, 22 includes an individual axle aperture through which an axle passes, each axle passing through a wheel bore, such as bore 23 of wheel 14C, and rotatably supporting one of the plurality of wheels. As shown in FIG. 1, then, with each wheel that is carried by frame 12 there is an associated pair of axle apertures, one in each side rail, generally confronting one another and coaxial with a wheel axle associated with each wheel 14. For example, as better seen in FIG. 2, first and second side rails 20 and 22 each have an aperture 32, 34 respectively, through which a wheel axle 36 passes. Axle 36 rotatably supports wheel 14C. As shown in the Figures, the axle apertures have an oblong or oval configuration, though circular (FIG. 7) or other configurations may also suffice. The non-circular apertures interact with axle aperture plugs, such as plugs 38 and 40 described hereafter, to position the wheel in either a lower or upper position.

Figure 2:
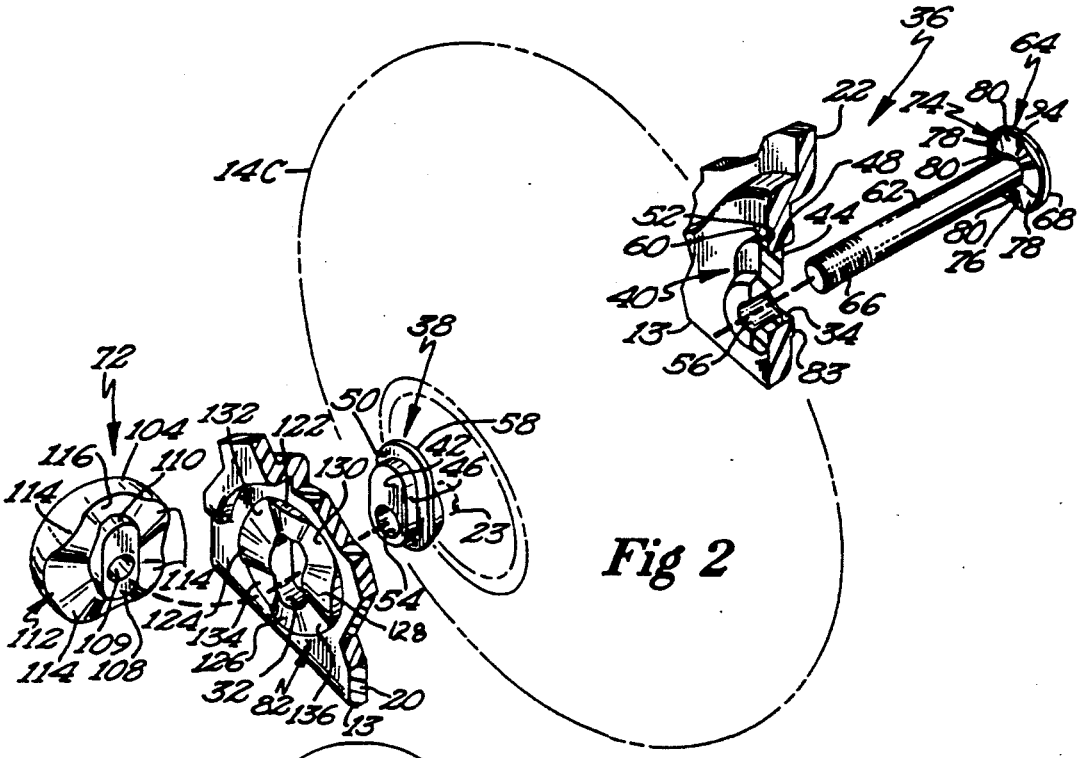
FIG. 2 is an exploded perspective view taken partly in section along cutting plane 3—3 and showing the fastening system of the present invention.

Referring now to FIG. 2, axle aperture, or fastening, plugs 38, 40 are matingly received within axle apertures 32, 34, respectively. The plugs 38, 40 each have a laterally extending, generally oblong lug 42, 44, respectively, whose outer periphery 46, 48 is mateably, frictionally received and retained in each axle aperture 32, 34, respectively of the frame 12. The lugs have a length less than the thickness of the side rails 20 or 22 of the frame. Plugs 38 and 40 each have a collar 50, 52 respectively, that extends radially outwardly from the its respective lug 42, 44, bears against the inner surface of the adjacent side rail, and provides a convenient means by which an installer can easily insert or remove the plug from the axle aperture when necessary to adjust the wheels.

An axle bore 54, 56 passes entirely through plug 38, 40, respectively and is sized to receive axle 36 therein. The bores 54, 56, are positioned eccentrically on the oblong lugs, which may have a spacer such as raised annular rim 58, 60, encircling bores 54, 56, respectively, and extending laterally toward the wheel 14C. When a plug, such as plug 38 is positioned in axle aperture 32, the annular rim 56 provides a washer-like mechanism which contacts the inner race of the adjacent wheel bearing and thereby assures necessary clearance between the outer race of the bearing and the side rail 20 of the frame.

The use of the axle plugs as described allows the skater to rocker the wheels as desired; that is, the skater may position the wheels at two or more different elevations to enable him to skate on different numbers of wheels. For a full explanation of the advantageous use to which axle plugs 38, 40 may be put, reference may be had to U.S. Pat. 4,909,523 to Olson and to U.S. Pat. Nos. 5,048,848 to Olson et al. and 5,092,614 to Malewicz, all of which are assinged to the same assignee as the present invention, whose teachings concerning the axle plugs, the non-circular axle apertures, and rockering are incorporated herein.

The apertures and plugs are shaped so the plugs cannot rotate between these two positions or orientations without first being manually withdrawn from the apertures and manually rotated by the assembler. The oblong configuration of the apertures and the plugs comprise one type of anti-rotation means for selectively maintaining the plugs in predetermined orientation. It should be understood that the axle apertures and mating plugs need not be oblong or oval and could instead be square, rectangular, triangular or any other regular or irregular geometric configuration which resists unwanted rotation. All such anti-rotation alternative configurations are within the purview of the invention.

Figure 3:
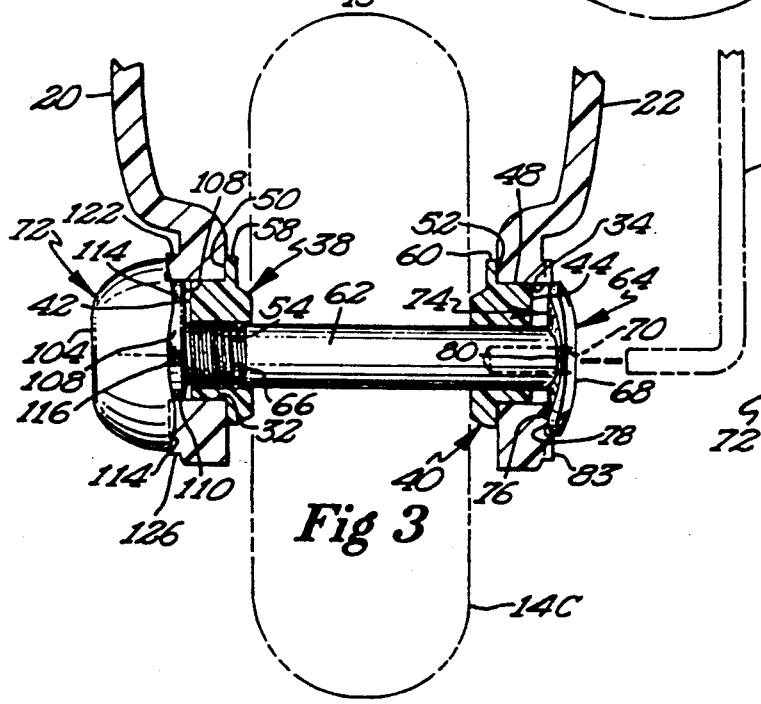
FIG. 3 is a cross sectional plan view taken along cutting plane lines 3—3 of FIG. 1 showing a wheel attached to an in-line roller skate frame using the fastening system of the present invention.

Each of the axles rotatably supporting wheels 14A, 14B, 14C, and 14D is substantially identical. Thus, for example, axle 36, as shown is FIGS. 2 and 3, is formed by a bolt having a bolt shaft 62, a head 64 disposed at one end of shaft 62 and a threaded end 66 disposed at the other end of shaft 62. The head 64 is preferably provided with a wide, smoothly contoured top or outer side 68 having a countersunk allen socket 70, best seen in FIG. 3. Axle 36 is passed through frame 12 such that threaded end 66 extends beyond the side rail 20. A threaded fastener such as fastener 72 is threadably received on bolt end 66. The head 64 and fastener 72 collectively comprise a clamping means on the axle by which the axle aperture plugs and wheel 14C may be tightly retained on the skate frame. When the bolt and fastener are tightened, the clamping effect forces the annular rims 58, 60, of the axle aperture plugs against the inner race of each bearing, thereby securely retaining the inner races of the bearings. The outer race of each bearing then rotates freely about the axle to permit easy and fast rotation of the wheels.

Figure 7:
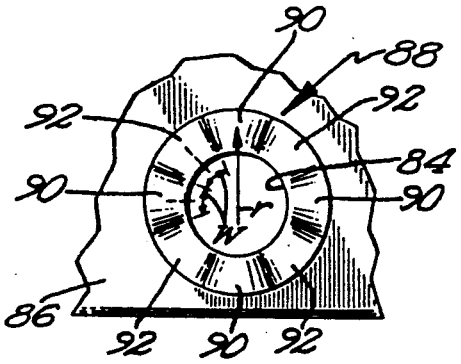
FIG. 7 is a plan view of a frame or other article of manufacture showing an alternate form of undulating patterns.

As noted previously, an in-line roller skater can generate significant vibration and shock forces during skating. These forces can cause the threaded fasteners currently used to secure the threaded end of the bolt, which most often comprise a threaded nut, to work free thereof. The fastening system of the present invention prevents the fastener from coming unthreaded from the bolt end as well as prevents damage to the frame due to overtightening of the fastener. Thus, a fastener in accord with the present invention will include a bolt head such as bolt head 64 having a lower surface 74 having an undulating surface pattern 76. Surface pattern 76 is comprised of a series of alternating high and low areas 78 and 80, respectively. The high areas 78 are all of substantially the same configuration, having substantially the same height. The low areas 80 are substantially identically configured, having substantially the same depth and may have the same, but inverted, configuration as that of the high areas 78. The surface pattern 76 must be periodic; that is, it must have an equal number of high areas and low areas equably distributed around the surface pattern 76. Preferably, surface pattern 76 will have at least two high areas and two low areas. The high areas may have a radial variation as may the low areas, but preferably will not have an angular variation. That is, the height of the peaks of the high areas 78 may be varied along a radius r extending outward from the center of apertures 32 and 34. In other words, the peak height may be constant in a radial direction, or may increase or decrease as desired. As best seen in FIG. 7, the circumferential width w of each high and low area may increase as the radius r from the aperture center increases. Surface pattern 76 is preferably regularly contoured, with the low areas merging smoothly with the high areas so as to not present a sharp, gouging surface to frame 12.

By way of a preferred example only, the entire surface pattern 76 may have a sine wave configuration and may be described by the equation:

$$f(\psi)=A\sin(n\psi+\phi), \quad (1)$$

where

A = amplitude of the wave;

n = the number of wave cycles around the annular surface, with $n \geqq 2$;

$\psi$ = the angular displacement around the lower side; and $\phi$=the phase angle.

The angle $\psi$ is measured with respect to a predetermined reference axis established on the surface pattern 76. Obviously, since the reference line may be established at any desired orientation with respect to surface pattern 76, the angle $\phi$ may vary from 0 to $\pi/2$. In a representative embodiment of the present invention, the amplitude A may be about 0.0125 inches and n may equal 4. With such a configuration, the height difference between the peaks of the high areas and nadirs of the low areas will be equal to twice the amplitude and there will be four high areas and four low areas on the surface pattern 76, as shown in FIGS. 2, and 5–7.

As a representative embodiment of a surface having discontinuities, if desired, each of the low areas 80 may be simply a substantially flat surface and the high areas 78 may be flat. In such a circumstance, the equation describing a surface having peaks having a sine wave configuration would be $$f(\psi)=A\sin(n\psi) \quad (2)$$

for n=4 and for some $\psi=0$ to $\pi/4$; $\pi/2$ to $3\pi/4$; $\pi$to $5\pi/4$; and $3\pi/2$ to $7\pi/4$; and $$f(\psi)=\pm cA,$$

for all other $\psi$, and where $c=\sin(\pi/4)$.

More generally, surface pattern 76 can be represented by the following equation:

$$g(r, \psi+\phi)=A(r)B(\psi+\phi), \quad (3)$$

where $g(r,\psi+\phi)$=a function dependent on r and $\psi$;

A(r)=a function dependent on r, the radius from the center of the bolt shaft to the edge of the bolt head; and $B(\psi+\phi)$=a function dependent on $\psi$, the angular displacement around the under surface of the bolt head, where $\phi$ is the phase angle.

The fastening system of the present invention further comprises an article, such as side rails 20 and 22 of frame 12 into which axle 36 is inserted. Side rails 20 and 22 each have an undulating pattern 82, 83 respectively. Undulating pattern 83 engages bolt head surface pattern 76. In the embodiment shown in the Figures, such undulating patterns will be disposed on both side rails 20 and 22 because the frame 12 may be placed on either a left or right boot, and the bolt or axle 36, for principally aesthetic purposes, will be inserted into the frames of both left and right skates from the rail on the inside of the foot towards the inside rail. Undulating patterns will be required on both sides of frame 12 therefore. To make the assembly of the skates simpler and more efficient so as to make the frames easily interchangeable between either the left or right skate, undulating pattern 83 of side rail 22 will be substantially identical to undulating pattern 82 of side rail 20. It will be understood that the description of surface pattern 82 will also be descriptive of the corresponding undulating pattern 83 on side rail 22.

Because surface pattern 82 has an undulating surface configured to matingly engage surface pattern 76 of bolt head 64 disposed around an oblong axle aperture, its description, while covering all cases generally, is complex. Thus, it is deemed best to describe first a simpler surface such as that surrounding a circular axle aperture such as aperture 84 of FIG. 7. Aperture 84 is disposed in an article of manufacture, such as an in-line skate side rail 86 that does not allow rockering of the wheels. Aperture 84 is surrounded by an undulating pattern 88 having a substantially circular configuration, though other configurations are within the purview of the present invention. Surface pattern 88 has a plurality of alternating high and low areas 90 and 92, respectively. As shown in the Figure, the surface is periodic with an equal number of peaks and valleys, the number being equal to the number of peaks and valleys found on surface pattern 76 of bolt head 64. With a circular aperture such as aperture 84, undulating pattern 88 may simply be a mirror image reflection of surface pattern 76 of bolt head 64. If surface pattern 76 is defined by the equation (1) given above, then surface pattern 88 may be similarly described.

Referring now to FIGS. 8–11, a more complete wheel structure will be described to further delineate the present invention. The wheel shown and subsequently described is exemplary of the type of wheel that may be used with the principles of the present invention and it should be understood that other wheel configurations will also function with the present invention. The wheel shown in the Figures is described in greater detail in Olson U.S. Pat. No. 4,909,523, referred to above. Thus, wheel 14C includes a resilient outer tire member 200 molded to an integral central hub 202. Hub 202 is comprised of inner and outer concentric hub rings 204 and 206 joined by a plurality of substantially rigid vanes 208. Inner ring 204 has left and right bearing apertures 210 and 212 into which substantially identical bearings 214 and 216 are respectively received and frictionally retained. Each bearing has a central axle bore 218, an inner race 220 and an outer race 222. Bearings 214 and 216 overlie and receive the ends of a bearing sleeve 224. Sleeve 224 has a generally cylindrical configuration and a central sleeve bore 226 that closely surrounds axle 62. In the middle of sleeve 224 is a central raised shoulder 228 that abuts inner races 220 of bearings 214 and 216 to space the bearings apart.

Figure 8:
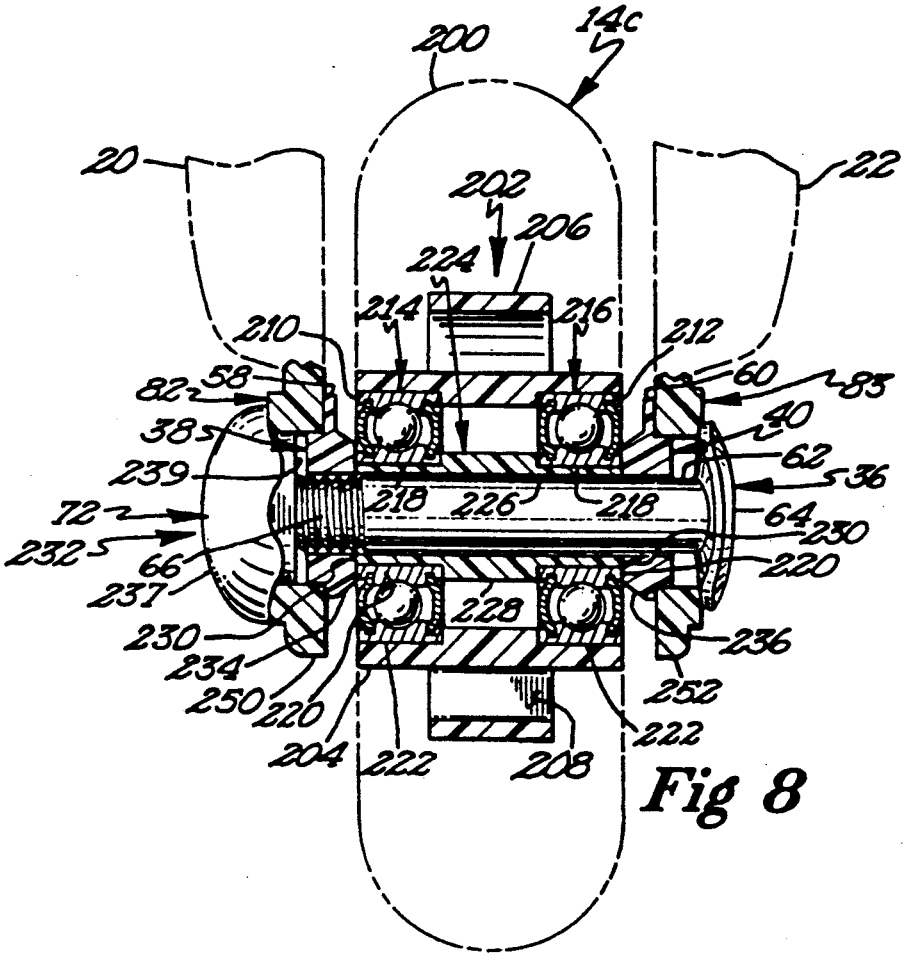
FIG. 8 illustrates in a cross sectional plan view a frame and wheel with its various associated component parts and with the low areas and the high areas of the bolt head engaging corresponding high and low areas of the frame undulating patterns.
Figure 9:
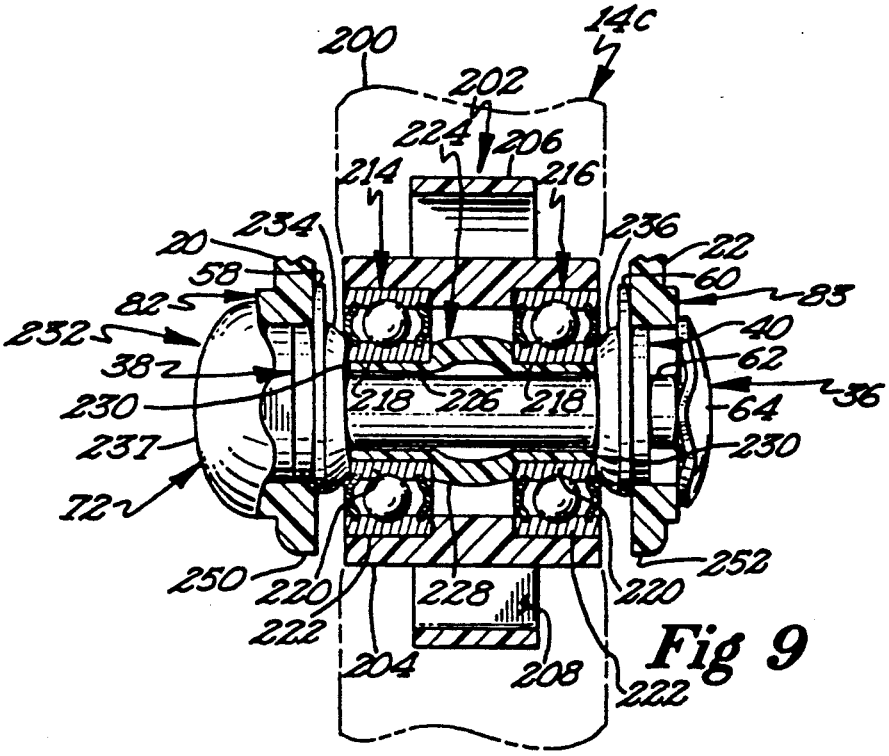
FIG. 9 illustrates the frame and wheel assembly shown in FIG. 8 wherein the axle has been tightened through 1/n revolutions such that the high spots of the bolt head undulating patterns are engaging the high spots of the frame undulating patterns, and further illustrates in exaggerated detail the deformation of various frame components from the resulting compressive force.
Figure 10:
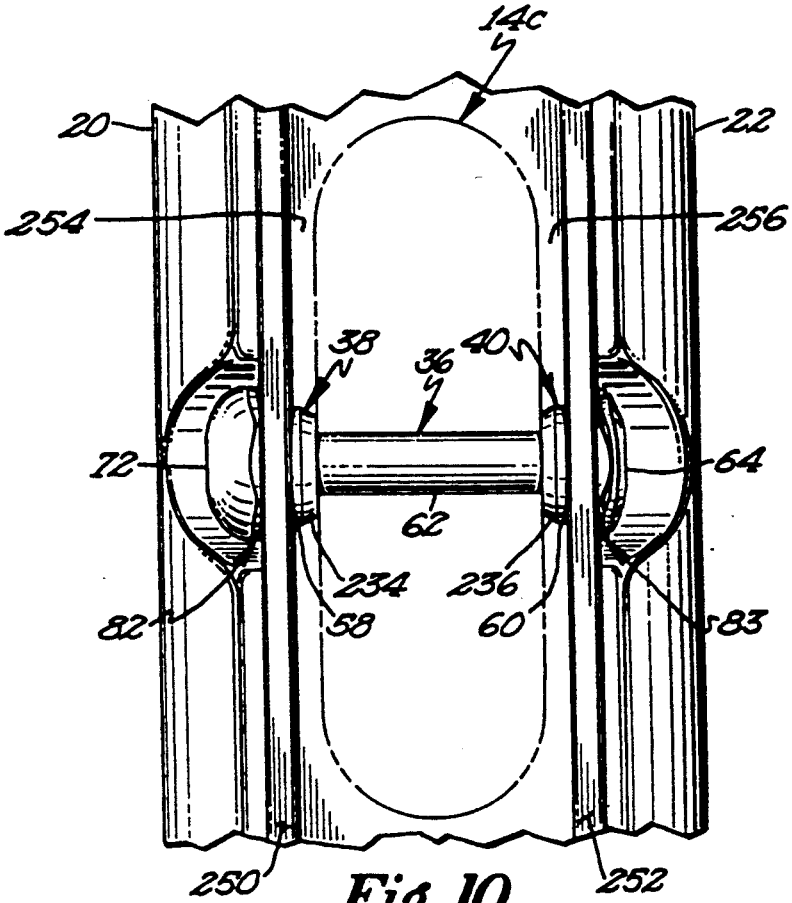
FIG. 10 shows the frame and wheel assembly of FIG. 8 in a bottom plan view.
Figure 11:
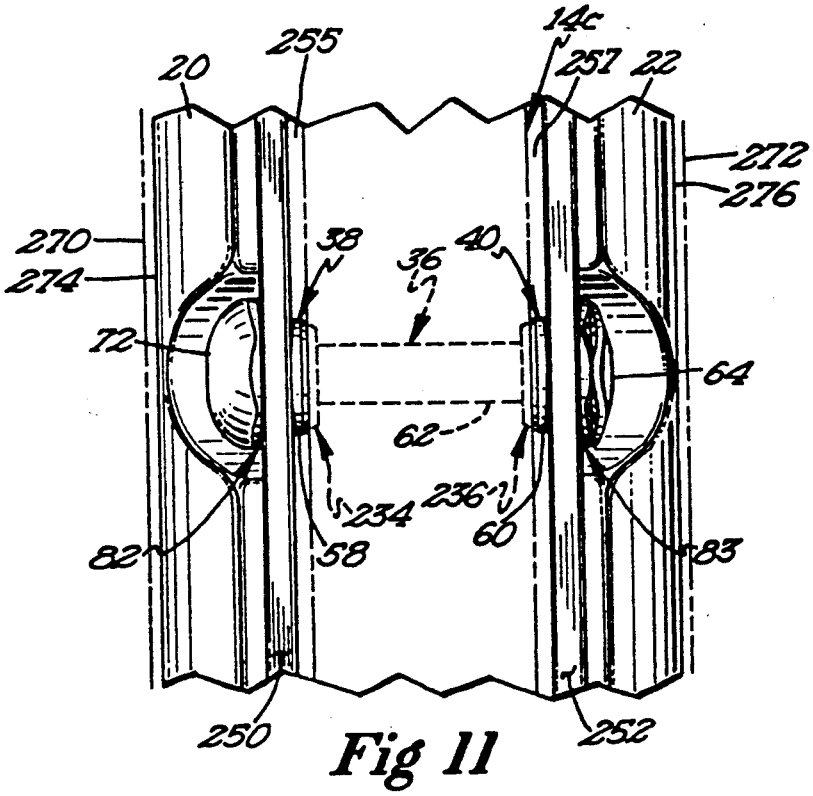
FIG. 11 shows the frame and wheel assembly of FIG. 10 showing the deformation of the frame as the axle is tightened so that the high spots of the corresponding undulating patterns are engaging each other.

Operatively, surfaces 76 and 88 will closely engage each other as axle 36 is turned into the threaded fastener. As shown in FIGS. 8 and 10, bolt axle 36 is in a relaxed position; that is, the high areas of the bolt head under surface 74 are shown engaging the low areas of frame undulating pattern 83. FIGS. 9 and 11 illustrate in exaggerated detail the effects of the compressive forces exerted on the frame and wheel assembly by the turning of the axle to tighten threaded fastener 72 on the threaded end 66 of axle 36. Thus, FIGS. 9 and 11 illustrate the deformations that may occur in the various component elements of the frame and wheel assembly when axle 36 is tightened on threaded fastener 72. As the fastener 72 is threaded onto threaded end 66, axle 36 is placed under tension while the components between bolt head 64 and fastener 72 are placed under compression. That is, while using an Allen-type wrench 71 inserted into socket 70, as threaded end 66 is turned into a threaded fastener such as a nut or fastener 72, high areas 78 of bolt head surface pattern 76 will encounter high areas 90 of undulating pattern 88 and the leading flanks of each high area, such as leading flanks 94 and 96, respectively (FIGS. 2 and 7 respectively) will exert opposing forces on the opposing high area. These forces will have components which are directed substantially parallel to the longitudinal axis of the axle, will result in the compression of the axle-frame-wheel system, and will increase until the peaks of the high areas are reached, as shown in FIGS. 9 and 11. The result is an increasing clamping or compressive force exerted inwardly on both sides of the frame. This force will cause a spring means 232, described hereafter, to deform, thereby elastically absorbing the exerted force caused by the turning of the axle 36 with tool 71. FIGS. 9 and 11 illustrate the position of axle 36 after it has been turned ½nth of a complete revolution. That is, when there are n high and low areas on the undulating patterns, turning the axle 1/n times a complete revolution will put the peaks of the high areas into engagement with one another. This is the position where the greatest compressive forces will be exerted on the frame and wheel assembly.

Spring means 232 may comprise either threaded fastener 72, bearing sleeve shoulder 230, fastener plugs 38 and 40, side rails 20 and 22, or a combination thereof, depending on the types of materials used for each component. The force exerted by the tightening of the axle 36 will thus be taken up by elastic spring means 232 lying along the axis of the axle 36. Spring means 232 will slightly deform or flex as a result. Thus, as shown in FIG. 9, inwardly directed compressive forces act along the axis of axle 36. These forces are transmitted substantially therealong from the outer side of the side rails inwardly through the frame side rails 20 and 22, the axle aperture plugs 38 and 40, through the inner races 220 of bearings 214 and 216 and into bearing sleeve central shoulder 228. Shoulders 234 and 236 of annular rims 58 and 60 of aperture plugs 38 and 40, respectively, are slightly, but shown quite exaggeratedly, bowed outward by the compressive forces. Similarly, bearing sleeve central shoulder 228 is shown bowed outward in exaggerated detail in FIG. 9 as the compressive forces are transmitted thereagainst. Inner races 220 of bearings 214 and 216 are shown slightly, but exaggeratedly displaced inwardly with respect to outer races 222. This relative movement of the inner and outer races 220 and 222, respectively, is limited to the play that naturally exists therebetween. Lastly, threaded fastener 72 may experience an inward deformation of its outer surface at 237 and lug 108 thereof may be pulled inwardly to close a gap 239 between lug 108 and lug 42 of aperture plug 38.

FIG. 11 illustrates in exaggerated detail the deformation of frame side rails 20 and 22. As seen in FIG. 10 when axle 36 is in the rest position shown in FIG. 8, bottom edges 250 and 252 of side rails 20 and 22, respectively, have a substantially linear configuration. In FIG. 11, edges 250 and 252 are deformed or flexed inwardly as axle 36 is tightened ½nth of a complete revolution, resulting in an obscuring of the aperture plugs 38 and 40 by reason of the closing of gaps 254 and 256, respectively, between wheel 14C and side rails 20 and 22, respectively. FIG. 11 also illustrates the deformation of annular rims 58 and 60 of axle aperture plugs 38 and 40. FIG. 11 further indicates the inward deformation that threaded fastener 72 may experience along its outer surface at 237 thereof as well as the flexure of the side rails 20, 22 from their rest position as indicated by dotted lines 270, 272, respectively, which mark the unflexed or rest position of the rails in exaggerated detail, to their displaced positions 274, 276 respectively. As noted above, this rail flexure results in alternately narrowing and expanding of the gaps 254 and 256 as the fastener 72 is tightened onto axle threaded end 66.

FIGS. 8 and 10, then, illustrate the frame and wheel assembly in its rest position while FIGS. 9 and 11 show the same after axle 36 has been turned ½nth of a complete revolution. The compressive forces generated during the tightening are absorbed by at least one of the spring means 230 disposed along the axis of axle 36 and then released as a restoring force to bring the surface patterns into a mutual, lockable engagement as the axle is turned another ½nth of a complete revolution to once again bring axle 36 into the relaxed position shown in FIGS. 8 and 10. As the peaks of the high areas are turned past one another, the inwardly directed compressive force will decrease until the peaks are intermeshed with the valleys, thus placing the frame and wheel assembly in the relaxed position. As the peaks slide into the valleys, however, the elastic forces stored by the deformation of the various skate components will be substantially released and will act as a restoring force, thereby driving the undulating patterns of the bolt head 64 and the frame side rail 22 and the undulating patterns 112 of the threaded fastener 72 and that of the frame side rail 20 into tight, lockable, mating engagement with each other. The compressive force will not be completely released, however, since the fastener 72 will have been tightened somewhat onto threaded end 66 and the clamping effect previously referred to will be present. As the turning of axle 36 is continued, the compressive force will again be exerted until the apexes of the peaks meet and then will again decrease as the peaks slide into the corresponding adjacent valleys of the opposing surface. Continuing to screw threaded end 66 into the threaded fastener will again force the high areas of surface pattern 76 and 88 against each other, again exerting an inwardly directed compressive force against the side rails and again resulting in the types of deformations seen in FIGS. 9 and 11. Each time the high areas are turned into each other the force required to do so will increase until a noticeably excessive amount of force is required to turn the axle, thereby providing the assembler with a direct indication of when to stop. This self-indicative system thus helps the assembler to avoid frame damage resulting from gouging due to overtightening.

Thus, the axle-frame-wheel system will experience an alternating compressive and relaxing force as axle 36 is threaded into fastener 72. For each 1/nth turn of axle 36, then, the frame and wheel assembly will experience a force resulting in the deformation of the component skate parts and then an elastic rebound of those parts to drive the undulating patterns into a close lockable engagement with each other. While generally a compression/release force, with fastener 72 the force is partly an extension/release mechanism. That is, lug 108 may be stretched, i.e., pulled or deformed into the axle aperture 32 as the high areas engage and then elastically rebound as the high areas engage the low areas. Additionally, the material disposed between nut 102 and the frame side rail will be compressed and then released through the same 1/nth turn described relative to lug 108. The overall compressive force will continue to increase as the threaded axle end 66 is turned into fastener 72 even though it will alternately be increasing and decreasing. Wheel 14C will be clamped increasingly tighter between rails 20 and 22 as the axle threaded end 66 is turned into fastener 72. With the present configuration, for the axle threaded end 66 and fastener 72 to work free of each other, a force sufficient to overcome the outwardly directed force exerted by the tightly clamped skate parts must be exerted. This loosening force must be sufficiently strong to reverse the rotation of the bolt head relative to the frame and to recompress the skate parts, i.e., the spring means 232, lying between the bolt head and the fastener along the axis of axle 36. Since skating generated forces are almost always insufficiently large, fastener 72 should almost never work free of threaded end 66 due to skating generated forces alone.

While the deformation of the skate parts has been described as occurring in various portions of the skate along the axle axis, it should be understood that other portions of the skate may also deform. For example, since the inner races 220 of the bearings 214 and 216 are usually made from steel, they will be incompressible relative to the synthetic materials utilized. Should a bearing be made with inner races formed of a softer material, deformation, if slight enough to be tolerated structurally and operatively, may occur therein. Additionally, the amount of deformation experienced by the various parts will depend on their relative abilities to deform elastically. Thus, substitution of one material for another may result in changing the relative amounts of deformations experienced between the various component parts lying along the axis of the axle 36. It should be understood that the deformations described will be slight and that those shown in FIGS. 9 and 11 are exaggerated. Additionally, though not shown in the Figures, it can be expected that frame side rail undulating patterns will experience deformation as the wheel is fastened to the side rails. Again, depending on the material used for the side rail, it can be expected that the high areas of the undulating patterns will be depressed slightly each time a wheel is attached anew to frame 12, and that, therefore, some of the compressive forces exerted on the frame will be absorbed by the undulating patterns resulting in a permanent deformation and wear thereof. With a material such as fiber glass impregnated nylon for the frame, however, it is expected that the undulating patterns could withstand well over a hundred cycles of loosening and tightening before the high areas would be so worn away as to require replacement of the frame, thus assuring many years of effective usage.

To assemble a wheel to a skate, then, the skater will insert the wheel axle 36 through the axle apertures 32, 40 such that the axle head 64 contacts a side rail and such that the threaded end 66 of the axle extends beyond the other side rail in position to receive the threaded fastener 72. The skater will then attach the threaded fastener and the axle threaded end 66 to each other by rotating either the fastener 72 or axle relative to the other to advance the threaded end 66 within the threaded fastener 72 so as to achieve a first level of tightness. After having achieved the first level of tightness and encountering the initial engagement of the high areas of the corresponding undulating patterns, the skater then will apply additional force to overcome the resistance generated by the engaging portions of the surfaces of the frame and the rotating member. The engaging portions of the surface patterns thus constitute discrete rotation resisting barriers that are interposed between the rotating member, such as axle 36 or threaded fastener 72, and its corresponding side rail. Overcoming each discrete barrier provides an indication that another level of tightness has been achieved. Thus, overcoming each barrier provides an indication to the skater or other assembler that additional, greater levels of tightness have been achieved.

It has been observed that a soft but audible click may be heard as the peaks of the pattern slide into the valleys. This click provides an audible signal to the person assembling the wheel to the frame that the fastener is getting tightly screwed onto threaded end 66 of axle 36. Depending upon the peak height, the assembler may be told to listen for a certain number of clicks and then to stop turning as that number is reached. For example, where surfaces 76 and 88 are defined by sine wave type of functions and the amplitude equals 0.0125 inch, the assembler should stop turning after hearing or feeling at most four or five of such clicks. The fastening system of the present invention thus provides at least two perceptible indicators of when it is properly tightened, namely, hearing the clicks and feeling the interactions of the engaging surface patterns. As a further indication of proper tightening, bolt head 64 may have a square configuration and the surface pattern 76 thereof may be disposed on bottom surface 74 so that a straight side of the bolt is aligned substantially parallel with some feature of frame 12, such as frame bottom 13, when axle 36 is properly fastened.

Figure 4:
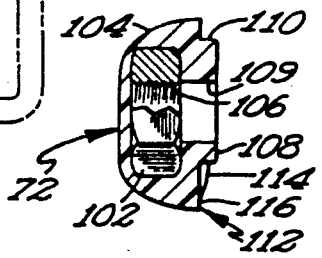
FIG. 4 shows a cross sectional plan view of a threaded fastener useful in the fastenig system of the present invention wherein a nut is encapsulated in a decorative anchor.

As previously noted, frame 12 is typically constructed to be attached to either a left or right boot. Since for aesthetic reasons it is desired that the same general image be presented regardless of which boot the frame is attached to, axle 36 must be insertable into frame 12 from either side. This requires both side rails to have undulating patterns for interaction with bolt head surface pattern 76. Having an undulating pattern on each frame side rail in turn requires threaded fastener 72 to have an undulating pattern 112 conformable to undulating pattern 82 of side rail 20 or to undulating pattern 88 when a circular aperture such as aperture 84 is used. As shown in FIGS. 2, 3, and 4 fastener 72 may be a one piece unit comprising a steel nut 102 encapsulated in a cover 104 formed of a synthetic material such as nylon. Nut 102 has internal threads 106 that receive and retain threaded end 66 of axle 36, best seen in FIG. 4. Fastener 72 further includes an anti-rotation means such as oblong or oval lug 108. Preferably, lug 108 has a periphery 110 configured to frictionally engage the side rail axle aperture, such as aperture 32 as shown in FIGS. 2 and 3, thereby enabling the assembler to place the fastener into position during wheel assembly and have it retained there. Lug 108 should have a thickness $t_1$ which is less than the thickness of the side rail; together, the thickness $t_1$ of lug 108 and the thickness $t_2$ of lug 42 of axle aperture plug 38 should be less than or equal to the thickness $t_3$ of side rail 20 or 22. Lug 108 includes an axle bore 109 into which threaded end 66 of axle 36 may be inserted for threading into nut 102.

Lug 108 of fastener 72 depends from an undulating surface 112 of cover 104. When used in relation to a circular aperture such as aperture 84 of FIG. 7, undulating surface 112 may simply be a mirror image of the frame undulating pattern 88. When undulating patterns 112 engage undulating patterns such as surface pattern 82 of side rail 20 or 83 of side rail 22, the surface interaction becomes more complex. These surfaces are configured to be operable in either of the dual positions that axle aperture plugs 38 and 40 may be disposed, as fully discussed in the previously referred to U.S. Pat. No. 4,909,523. As such, they are somewhat more complex since, like bolt head undulating pattern 76, they must be able to successfully engage the frame when plugs 38 and 40 are in either of their two possible positions. As shown in FIG. 2, plugs 38 and 40 are respectively disposed in side rails 20 and 22 in the lower position. Inverting the plugs would raise the center of the plug bores 54 and 56 relative to axle apertures 32 and 34, respectively, thereby raising the axle 36 relative to frame apertures 32 and 34. Thus, when a multiple position plug is used, undulating patterns 82 and 83 must be capable of accommodating surface pattern 76 of bolt head 68 and fastener undulating patterns 112 in either the upper or lower position.

Fastener undulating surface 112 includes n high areas 114 rising above n low areas 116, each of which will engage a low or high area respectively on undulating pattern 82 when threaded end 66 is received by nut 102. Fastener 72 need not engage undulating pattern 82 as closely as bolt head surface pattern 76 engages undulating pattern 83 since lug 108 will prevent fastener 72 from rotating. If desired, the undulating patterns of fastener 72 and frame side rail 82 could serve as the anti-rotation means for fastener 72, in which case the two surfaces would need to closely conform to each other. Surface pattern 112 may include substantially flat surfaces for low areas 116 if desired.

Figure 5:
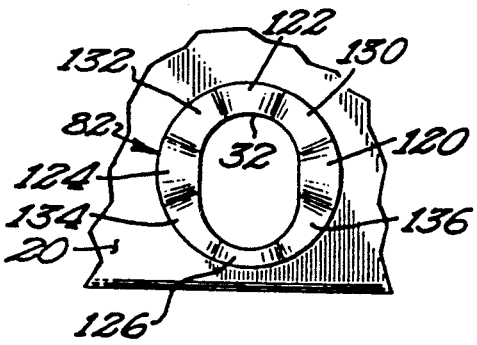
FIG. 5 is a plan view of a portion of an in-line roller skate frame or other article of manufacture wherein the fastening system of the present invention is used, the frame having undulating patterns in accordance with the present invention for mating with a multiply positionable bolt.

Referring principally now to FIGS. 2 and 5, surfaces 82 and 83 will be described. Because they are substantially identical, reference will be made only to undulating pattern 82, it being understood that the description is also applicable to surface pattern 83. Thus, surface pattern 82 has an undulating configuration of circumferentially alternating high and low areas 120, 122, 124, 126, and 130, 132, 134, and 136, respectively. Low areas 130, 132, 134, and 136 are substantially identically configured and should have a circumferential width sufficient to encompass high areas 78 of bolt head surface pattern 76 so that they will snugly engage each other.

High areas 120 and 124 are substantially identically configured as are high areas 122 and 126. Area 122 is only minimally engaged by bolt head surface pattern 76 when plugs 38 and 40 are disposed in apertures 32 and 34 respectively with bores 54 and 56 in the down or lower position. Conversely, rockering the plugs so that bores 54 and 56 are in the top or upper position results in a minimal engagement between surface pattern 76 and high area 126. Consequently, areas 122 and 126 can be configured as mirror images of high areas 78 of bolt head surface pattern 76.

High areas 120 and 124, unlike high areas 122 and 126, are significantly engaged by bolt head surface pattern 76 when plugs 38 and 40 are in both the upper and lower positions. As such, their configuration cannot be a simple mirror image of the high area 78 of bolt head surface pattern 76; the circumferential extent of areas 120 and 124 must be narrower than that of areas 122 and 126 so that these areas can successfully engage a low area 80 of bolt head surface pattern 76 in either the upper or lower positions. In this sense, areas 120 and 124 may be referred to as a minor peaks in comparison to major peaks 122 and 126. Were minor peaks 120 and 124 of the same width as major peaks 122 and 126, they would not properly engage the low areas 80 of bolt head surface pattern 76.

Figure 6:
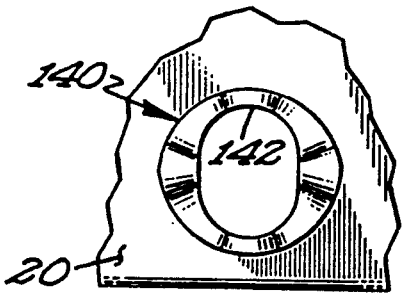
FIG. 6 is a plan view of a frame or other article of manufacture showing an alternate form of undulating patterns.

FIG. 6 shows an alternative embodiment of an undulating pattern 140 surrounding an oblong aperture 142. Undulating pattern 140 is substantially similar to undulating pattern 82 except that its surface is completely symmetrical with respect to the center of aperture 142 whereas undulating pattern 82 is not completely symmetrical with respect to center of aperture 32. That is, as clearly indicated by FIG. 5, major peak 122 has a greater radial extent than major peak 126. In all other respects, undulating patterns 142 is identical to that of undulating pattern 82. Major peak 122 has a greater extent than major peak 126 because it has been found that most in-line roller skaters who have the capability of setting the wheel height as desired, will dispose their wheels on the skate frame such that they are all at the same height for the substantial majority of the time. Thus, FIG. 5 represents undulating patterns wherein the particular wheel associated with that undulating patterns would be disposed in the upper position when all wheels are at the same height. If the wheel were to be disposed in the lower position, then the undulating patterns would be inverted.

Referring now to FIG. 1, the description of the frame and the undulating patterns will be described with reference to brake assembly 18. Brake assembly 18 comprises a brake 150 having a braking surface 152. Brake 150 is held by a U-shaped member 154 having a pair of forwardly extending arms, only one arm 156 being shown in an exploded fragmented view. As shown, arm 156 has an undulating pattern 158 that conforms to an undulating pattern 160 disposed in association with the rearwardly most wheel 14D. Undulating patterns 158 of arm 156 functions similarly to undulating patterns 82 and 88 as previously described. To provide a close fit between arm 156 and frame 12, a mirror image undulating patterns should be disposed on the inner side of arm 56 to closely engage undulating patterns 160. Thus, in a manner similar to that previously described with reference to wheel 14C, wheel 14D and brake assembly 18 can be securely fastened to frame 12. If only one skate of a pair of skates has a brake, as is typically the case, then the rear skate wheel on the skate that does not have the brake will be fastened to frame 12 in the same manner as described with reference to wheel 14C.

The various undulating patterns, such as surface pattern 76 and surface pattern 88 in particular, are preferably smoothly contoured, continuous surfaces. Such surfaces present no sharp edges that will result in gouging or other damage to the frame undulating patterns. Undulating pattern 82 should also be smoothly contoured. It has been noted that discontinuous surfaces will also suffice; though certain surfaces, such as those represented by a square wave, will obviously not work since there will be no ramping effect created by the peaks of the wave.

The various frame undulating patterns described herein and shown in the Figures are shown as being raised above an otherwise substantially flat frame surface. The frame undulating patterns could, however, be disposed within the frame side rail such that little, if any, of the peaks of the high areas appeared above the flat surface of the side rail. This could result in a weakening of the frame and breakage in those areas, though, and is not preferred unless the frame is accordingly strengthened.

While the present invention has been described as resulting in generally full facial engagement of the patterns, it is not necessary that all portions of one member's undulating surface be in complete facial contact with the opposing member's undulating surface to achieve an effective lockable engagement. Thus, the present invention contemplates engaging surface patterns where only selected portions of the patterns are in facial contact when they are engaged. As a first example only, when oblong axle apertures are used, such as apertures 32 and 34, the pattern surrounding the apertures may be configured such that only certain portions of the undulating surface patterns may be in facial contact with each other. Thus, focusing on pattern 82 in side rail 20 as an example, when the aperture plugs 38 and 40 are disposed such that the axle bores 54 and 56 are in the lower portion of the apertures 32 and 34 when plugs 38 and 40, respectively, are installed in the frame, only the bottom portion of low area 130 and the adjacent top portion of high area 128, the bottom portion of low area 132 and the adjacent upper portion of high area 124, and the bottom portions of low areas 134 and 136 and the intervening high area 126 of pattern 82 will facially contact the opposing high and low areas of undulating pattern 112 of fastener 72. When the aperture plugs 38 and 40 are reversed, i.e., when the axle bores 54 and 56 are disposed in the upper portion of apertures 32 and 40, then the remaining portions of pattern 82 that were not in facial engagement with the opposing areas of pattern 112 in the first example will now be in facial engagement while the portions of pattern 82 and their counterpart surfaces delineated in the first example will not be in complete facial engagement. Top and bottom as used in this paragraph refer to portions of the undulating patterns measured in a plane perpendicular to the axis of axle shaft 36.

Fastener 72 has been described as a one piece unit. Other known forms of fasteners, such as that described in U.S. Pat. No. 5,068,956 to Malewicz, assigned to the same assignee as the present invention, may include undulating patterns in conformance with the previously described invention. If desired, and if the synthetic material forming cover 104 possesses sufficient strength, nut 102 may be excluded and threaded axle end 66 simply screwed into cover 104.

Having thus described the present invention, other modifications, alterations, or substitutions may now suggest themselves to those skilled in the art, all of which are within the spirit and scope of the present invention. It is therefore intended that the present invention be limited only by the scope of the attached claims below.

I claim:

1. A fastening system for attaching a wheel to an in-line roller skate, said in-line roller skate having a frame including first and second side rails, said side rails being provided for mounting therebetween at least one wheel having a wheel axle bore and each said rail having an axle aperture, said fastening system comprising:

a wheel axle comprising a shaft and having a head at one end of said shaft, said head configured to receive a fastening tool means and having an axle head lower surface, said axle including a threaded end disposed at the other end of said shaft, said wheel axle being received within said wheel axle bore and within said axle aperture of said side rails to rotatably mount said wheel to said frame;

said first rail including at least one undulating, frame surface pattern positioned about said axle aperture and having n alternating high and low areas, where $n \geqq 2$;

said axle head having a axle head undulating surface pattern with high and low areas on said head lower surface for selectively lockably engaging said frame surface pattern of said first side rail during rotation of said axle, said axle head surface pattern and said frame surface pattern mutually configured for a high area of one of said frame and axle head surface patterns sized to be received within an opposing low area of the other of said patterns; and a threaded fastener adjacent said second side rail for threadably engaging and retaining said threaded end of said axle as said axle is rotated relative to said fastener;

said axle head surface pattern and said frame surface pattern are characterized by said high and low areas defining a substantially smoothly contoured surface, have a shape selected for opposing surfaces of said frame surface pattern and said axle head surface pattern to slip relative to one another during turning of said axle head until said axle is secured to said threaded fastener with a desired degree of tightness;

said frame surface pattern surrounding said axle aperture and extending radially therefrom with said frame surface pattern generally symmetrical about said axle aperture;

said frame surface pattern and said axial surface pattern resiliently biased toward one another with a biasing force sufficient for a high area of said axle surface pattern to override an opposing high area of said frame surface pattern against an urging of said biasing force until said axle is secured to said fastener with a desired tightness;

said opposing surface patterns resiliently biased toward one another with a biasing force sufficient for opposing high areas to override one another against an urging of said biasing force until said axle member is secured to said fastener member with a desired tightness;

whereby engagement of said axle head surface pattern with said first side rail undulating surface pattern substantially prevents said axle from inadvertently rotating and being loosened by skating generated forces.

2. The fastening system of claim 1 and further including:

an axle aperture plug including a collar and a lug, said lug configured for mateable reception by said axle aperture in said first side rail, said lug being inserted into said aperture from a first direction, said collar extending radially outward from said lug to bear against said first side rail, said plug including an axle bore, and said wheel axle shaft passing through said bore.

3. The fastening system of claim 1 wherein said second side rail includes:

at least one undulating surface pattern positioned about said axle aperture and characterized by m alternating high and low areas, where $m \geqq 2$, said surface pattern extending radially outward from said axle aperture of said second side rail;

and wherein said threaded fastener includes:

a threaded bore; and an undulating threaded fastener surface pattern lockably engagable with said pattern of said second side rail, said fastener surface pattern being characterized by a substantially smoothly contoured undulating surface extending circumferentially about said threaded bore.

4. The fastening system of claim 3 wherein said threaded fastener undulating pattern is defined by:

$$f(\psi) = A \sin(m\psi),$$

where

A = amplitude of the wave;

m = the number of wave cycles; and $\psi$ = the angular displacement around said threaded fastener surface pattern.

5. The fastening system of claim 3 wherein said fastener undulating pattern is defined by:

$$g(r,\psi+\phi)=A(r)B(\psi+\phi),$$

where $g(r,\psi+\phi)$ = a function dependent on r and $\psi$;

A(r) = a function dependent on r, the radius from the center of the fastener to the edge of the fastener, and $B(\psi+\phi)$ = a function dependent on $\psi$, the angular displacement around the lower surface of the fastener, where $\phi$ is the phase angle.

6. The fastening system of claim 3 wherein said second side rail axle aperture has an oblong configuration.

7. The fastening system of claim 6 wherein said fastener surface pattern comprises four high areas alternating with four low areas and said frame surface pattern comprises four peaks alternating with four valleys, each of said valleys having a circumferential extent sufficient to encompass a high area of said axle head, and wherein said peaks comprise:

first and second major peaks and first and second minor peaks, said major peaks being diametrically disposed about said oblong axle aperture and said minor peaks being diametrically disposed about said oblong axle aperture, said minor peaks having a lesser circumferential extent than said major peaks.

8. The fastening system of claim 7 and further including:

an axle aperture plug including a collar and a lug, said lug configured for mateable reception by said axle aperture in said first side rail, said lug being inserted into said aperture from a first direction, said collar extending radially outward from said lug to bear against said first side rail, said plug including an axle bore, and said wheel axle shaft passing through said bore, said axle aperture plug being received by said axle aperture in a first or second orientation so that the wheel of said skate may be rockered between first and second positions relative to said frame, wherein in said first position said first major peak is minimally engaged by said fastener surface pattern and said second major peak is significantly engaged by said fastener surface pattern relative to said first major peak, with said first and second minor peaks being significantly engaged when said wheel is in either said first or second rockered position.

9. The fastening system of claim 1 wherein n = 4.

10. The fastening system of claim 1 wherein said first side rail undulating surface pattern and said axle head undulating surface pattern are continuous surfaces.

11. The fastening system of claim 1 wherein said axle has a radius and each of said high areas includes a peak having a constant amplitude as measured along the radius of said axle.

12. The fastening system of claim 1 wherein said axle has a radius and each of said low areas includes a trough having a constant amplitude as measured along the radius of said axle.

13. The fastening system of claim 1 wherein said axle head undulating surface pattern is defined by:

$$f(\psi)=A\sin(n\psi),$$

where

A = amplitude of the wave;

n = the number of wave cycles; and $\psi$ = the angular displacement around the lower surface of said axle head.

14. The fastening system of claim 1 wherein said undulating patterns of said first side rail and said axle head are substantially mateably engagable.

15. The fastening system of claim 1 wherein said axle head undulating pattern is defined by:

$$g(r,\psi+\phi)=A(r)B(\psi+\phi),$$

where $g(r,\psi+\phi)$ = a function dependent on r and $\psi$;

A(r) = a function dependent on r, the radius from the center of the axle shaft to the edge of the axle head; and $B(\psi+\phi)$ = a function dependent on $\psi$, the angular displacement around the lower surface of the axle head, where $\phi$ is the phase angle.

16. The fastening system of claim 1 wherein said axle aperture has an oblong configuration.

17. The fastening system of claim 16 wherein said axle head surface pattern comprises four high areas alternating with four low areas and said frame surface pattern comprises four peaks alternating with four valleys, each of said valleys having a circumferential extend sufficient to encompass a high area of said axle head, and wherein said peaks comprise:

first and second major peaks and first and second minor peaks, said major peaks being diametrically disposed about said oblong axle aperture and said minor peaks being diametrically disposed about said oblong axle aperture, said minor peaks having a lesser circumferential extent than said major peaks.

18. The fastening system of claim 17 and further including:

an axle aperture plug including a collar and a lug, said lug configured for mateable reception by said axle aperture in said first side rail, said lug being inserted into said aperture from a first direction, said collar extending radially outward from said lug to bear against said first side rail, said plug including an axle bore, and said wheel axle shaft passing through said bore, said axle aperture plug being received by said axle aperture in a first or second orientation so that the wheel of said skate may be rockered between first and second positions relative to said frame, wherein in said first position said first major peak is minimally engaged by said axle head surface pattern and said second major peak is significantly engaged by said axle head surface pattern relative to said first major peak, with said first and second minor peaks being significantly engaged when said wheel is in either said first or second rockered position.

19. A method of fastening a wheel axle to an in-line roller skate, said in-line roller skate having a frame including first and second side rails, said side rails each having inner and outer sides with said inner sides facing each other, said side rails mounting therebetween at least one wheel having a wheel axle bore and each said side rail having an axle aperture, at least one of said side rails having discrete rotation resisting barriers on its outer side adjacent said axle aperture, said skate further including means for attaching said frame to an operator's foot, said wheel axle comprising:

an axle member including a shaft having an axle head at one end of said shaft and a threaded end disposed at the other end of said shaft, said axle member being receivable within said wheel axle bore and within said axle apertures of said side rails to rotatably mount said wheel to said frame, said wheel axle further including a threaded fastener member for engaging said threaded shaft end, said fastener member including discrete rotation resisting barriers thereon, said barriers characterized by opposing surface patterns having high and low areas defining a smoothly contoured surface, said surface patterns mutually configured for a high area of one of said patterns sized to be received within a low area of the other of said patterns, said patterns surrounding an axis of said axle with said high and low areas extending generally radially therefrom, said patterns rotating relative to one another as said axle is rotated relative to said fastener member, said patterns further contoured and resiliently biased toward one another to permit slippage of said patterns relative to another until said axle is secured to said fastener member with a desired degree of tightness;

wherein said method comprises the steps of:

inserting said axle member through a said axle aperture of a first side rail of said frame, through said wheel axle bore, and through the axle aperture of said second side rail such that said axle head contacts said outer side of said first side rail and such that the threaded end of said axle member is positioned to threadably engage said threaded fastener member;

aligning said threaded fastener member to receive said shaft threaded end and rotating one of said axle or threaded end members relative to the other of said members so as to advance said threaded end within said threaded fastener member such that said rotating member reaches a first level of tightness against a said side rail; and after said rotating member reaches said first level of tightness against said side rail, causing said rotation resisting barriers to engage and then applying force to further rotate said rotating members to overcome a plurality of said successively encountered, discrete rotation-resisting barriers to indicate to the operator's perception that additional levels of tightness are being reached as each barrier is encountered and to thereby prevent overtightening and unwanted loosening of the member.

20. The method of claim 19 wherein the resistance of each said barrier is selectively increased as said rotating member is rotated.

21. The method of claim 19 wherein said barriers are reached at approximately ninety-degree intervals of a complete rotation of said rotating member and continue for approximately a forty-five degree interval of a complete rotation of said rotating member.

22. The method of claim 19 wherein:

said barriers on said rotating member and said frame each include an undulating surface pattern; and said rotation resisting barriers are established by selectively engaging predetermined portions of the said surface patterns as said rotating member is rotated.

23. The method of claim 19 and further including the step of alternately compressing and releasing at least one spring means disposed substantially along the axis of said wheel axle as said rotating member is rotated and said rotation resisting barriers are sucessively encountered.

24. The method of claim 23 wherein the force required to overcome each said barrier increases as the barrier is being overcome and said rotating member is rotated.

25. The method of claim 23 wherein said barriers are encountered at intervals which comprise about one-fourth of a complete rotation of said rotating member and last for about the following one-eighth of a complete rotation of said rotating member.

26. The method of claim 23 wherein:

said rotating member and said frame each include an undulating surface pattern; and said rotation resisting barriers are established by selectively engaging predetermined portion of the said surface patterns as said rotating member is rotated.

27. The method of claim 19 wherein said method further comprises:

providing a signal to the operator to indicate when said rotation resisting barriers are overcome.

28. The method of claim 27 wherein said signal is an audible signal.

29. The method of claim 27 wherein said signal is manifested by the operator feeling the rotation resisting barriers being overcome.

30. A fastening system for attaching a wheel to an in-line roller skate, said skate including a wheel with a wheel axle bore therethrough, and said fastening system comprising a frame including first and second side rails for mounting said wheel therebetween and each said rail having an axle aperture;

a wheel axle comprising a shaft having a longitudinal central axis and having a head at one end of said shaft, said head having lower and upper surfaces, said axle including a threaded end disposed at the other end of said shaft, said wheel axle being received within said wheel axle bore and said axle apertures and rotatably mounting said wheel to said side rails;

said first rail including at least one undulating frame surface pattern positioned about said first side rail axle aperture and having high and low areas;

said axle head having an undulating axle head surface pattern on said head lower surface and selectively lockably engaging said side rail surface pattern during rotation of said axle about said central axis, said pattern having high and low areas, said frame and axle head surface patterns mutually configured for a high area of one of said patterns sized to be received within a low area of the other of said patterns;

a threaded fastener adjacent said second side rail for threadably engaging and retaining said threaded end of said axle as said axle is rotated relative to said fastener;

said axle head and frame surface patterns characterized by said high and low areas defining substantially smooth contoured surfaces with said frame surface pattern surrounding said axle aperture and extending radially therefrom with said frame surface pattern generally symmetrical about said axle aperture, said axle head and frame surface patterns selected for opposing surfaces of said pattern to slip relative to one other during turning of said axle head until said axle is secured to said threaded fasteners with a desired degree of tightening; and said fastening system further including:

at least one spring means disposed substantially along said axle axis wherein attaching said threaded fastener to said threaded axle end selectively exerts an inwardly directed force on both side rails of said frame, said force being absorbed by said at least one spring means and then released to push said side rail undulating surface and said axle head undulating surface into mutual locking engagement.

31. The fastening system of claim 30 wherein said wheel includes a pair of spaced apart bearings having inner and outer races and said fastening system further includes a bearing spacer for spacing said bearings and wherein said at least one spring means comprises said bearing spacer.

32. The fastening system of claim 31 wherein said bearing spacer includes a spacer bore for receiving said wheel axle and further includes a central shoulder for engaging the inner races of said bearings.

33. The fastening system of claim 30 wherein said at least one spring means comprises:

an axle aperture plug including a collar and a lug, said lug configured for mateable reception by a said axle aperture in a said side rail, said lug being inserted into said aperture from a first direction, said collar extending radially outward from said lug to bear against said side rail, said plug including an axle bore configured to receive said wheel axle shaft.

34. The fastening system of claim 30 wherein said at least one spring means comprises:

at least one of said side rails, said at least one side rail being sufficiently elastic to flex from a rest position to a displaced position as said forces are exerted by the engagement of the high areas on said undulating surfaces of said side rail and said axle head while attaching said threaded fastener to said threaded shaft end and to return to said rest position as said forces diminish as the high areas of each said undulating surface engage the low areas of each undulating surface.

35. The fastening system of claim 30 wherein said wheel includes a hub mounting a pair of spaced apart bearings and said fastening system includes a bearing spacer for spacing said bearings, said fastening system further comprising:

an axle aperture plug including a collar and a lug, said lug configured for mateable reception by a said axle aperture in a said side rail, said lug being inserted into said aperture from a first direction, said collar extending radially outward from said lug to bear against said side rail, said plug including an axle bore configured to receive said wheel axle shaft; and wherein said at least one spring means comprises said bearing spacer and said axle aperture plug.

36. The fastening system of claim 30 wherein said wheel includes a hub mounting a pair of spaced apart bearings and said fastening system further includes a bearing spacer for spacing said bearings, and wherein said spring means comprises:

said bearing spacer; and at least one of said side rails, said at least one side rail being sufficiently elastic to flex from a rest position to a displaced position as said forces are exerted by the engagement of the high areas on said undulating surfaces of said side rail and said axle head while attaching said threaded fastener to said threaded shaft end and to return to said rest position as said forces diminish as the high areas of each said undulating surface engage the low areas of each undulating surface.

37. The fastening system of claim 30 wherein said fastening system further comprises:

an axle aperture plug including a collar and a lug, said lug configured for mateable reception by a said axle aperture in a said side rail, said lug being inserted into said aperture from a first direction, said collar extending radially outward from said lug to bear against said side rail, said plug including an axle bore configured to receive said wheel axle shaft; and wherein said at least one spring means comprises:

said axle aperture plug; and at least one of said side rails, said at least one side rail being sufficiently elastic to flex from a rest position to a displaced position as said forces are exerted by the engagement of the high areas on said undulating surfaces of said side rail and said axle head while attaching said threaded fastener to said threaded shaft end and to return to said rest position as said forces diminish as the high areas of each said undulating surface engage the low areas of each undulating surface.

38. The fastening system of claim 30 wherein said spring means comprises said threaded fastener.

39. The fastening system of claim 38 wherein said fastening system includes an axle aperture plug including a collar and a lug configured for mateable reception by a said axle aperture in a said side rail, said lug being inserted into said aperture from a first direction;

said threaded fastener includes a lug insertable into said axle aperture of said side rail from a second direction and wherein a gap is provided between the lugs filling said axle aperture;

whereby applying said force causes said lug of said threaded fastener to be elastically urged into and out of said gap in response to tightening and loosening of said axle so as to define said spring means.

40. The fastening system of claim 30 wherein said axle aperture has an oblong configuration.

41. An in-line roller skate having a frame including first and second side rails, at least one wheel having an axle bore therethrough, said first and second side rails have aligned axle apertures, the improvement comprising:

a wheel axle having a shaft extending through said axle bore and said axle apertures, said axle including a head at one end of said shaft and a threaded end at an opposite end of said shaft, said head opposing said first rail and said threaded end extending through said axle aperture of said second rail;

a threaded fastener for threadably engaging and retaining said threaded end of said axle as said axle is rotated relative to said threaded fasterner, said threaded fastener presenting a fastener surface opposing said second rail;

an undulating frame surface pattern disposed on at least one of said first and second rail and opposing an axle surface pattern on at least one of said head and said fastener, said frame and axle surface patterns presenting a plurality of alternating high and low areas connected by a substantially smoothly contoured surface, said frame and axle surface patterns mutually configured for said high areas of said frame surface pattern sized to be received within said low areas of said axle surface pattern and with said high areas of said axle surface pattern sized to be received within said low areas of said frame surface pattern;

said axle and frame surface patterns characterized by being substantially smoothly contoured surfaces surrounding an axis of said axle and with said high and low areas extending generally radially therefrom;

said frame surface pattern resiliently biased toward said axle surface pattern with a biasing force sufficient for a high area of said axle surface pattern to override an opposing high area of said frame surface pattern against an urging of said biasing force until said axle is secured to said fastener with a desired degree of tightness.

42. A skate according to claim 41 wherein said axle surface pattern is disposed on said fastener surface and said frame surface pattern is disposed on said second rail.

43. A skate according to claim 41 wherein said axle surface pattern is disposed on said head and said frame surface pattern is disposed on said first rail.

44. A skate according to claim 41 wherein each of said head and said fastener surface are provided with an axle surface pattern and wherein each of said first and second rail is provided with an opposing frame surface pattern.

* * * * *

UNITED STATES PATENT AND TRADEMARK OFFICE

CERTIFICATE OF CORRECTION

PATENT NO. : 5,190,301

DATED : March 2, 1993

INVENTOR(S) : Andrzej M. Malewicz

It is certified that error appears in the above-identified patent and that said Letters Patent is hereby corrected as shown below:

Column 3, line 27, "multiply" should read --multiple--;

Column 3, line 67, "cross sectional" should read --cross-sectional--;

Column 4, line 3, "cross sectional" should read --cross-sectional--;

Column 4, line 4, "fastenig" should read --fastening--;

Column 4, line 11, "multiply" should read --multiple--;

Column 4, line 19, "cross sectional" should read --cross-sectional--;

Column 5, line 25, delete "the" after the word "from";

Column 5, line 52, "assinged" should read --assigned--;

UNITED STATES PATENT AND TRADEMARK OFFICE

CERTIFICATE OF CORRECTION

PATENT NO. : 5,190,301

DATED : March 2, 1993

INVENTOR(S) : Andrzej M. Malewicz

It is certified that error appears in the above-identified patent and that said Letters Patent is hereby corrected as shown below:

Column 6, line 2, "is" should read --are--;

Column 13, line 58, delete "a" after the word "as";

Column 14, line 4, "patterns 142" should read --pattern 140--;

Column 14, line 13, "patterns" should read --pattern--;

Column 14, line 16, "patterns" should read --pattern--;

Column 14, line 26, "patterns" should read --pattern--;

Column 14, line 30, "patterns" should read --pattern--;

Column 14, line 31, "patterns" should read --pattern--;

UNITED STATES PATENT AND TRADEMARK OFFICE

CERTIFICATE OF CORRECTION

PATENT NO. : 5,190,301

DATED : March 2, 1993

INVENTOR(S) : Andrzej M. Malewicz

It is certified that error appears in the above-identified patent and that said Letters Patent is hereby corrected as shown below:

Column 18, claim 17, line 31, "extend" should read --extent--;

Column 20, claim 26, line 22, "portion" should read --portions--;

Column 20, claim 30, line 37, insert --:-- after the word "comprising"; and

Column 22, claim 41, line 66, "fasterner" should read --fastener--.

Signed and Sealed this

Fifth Day of April, 1994

Bruce Lehman

*Attest:*

BRUCE LEHMAN

*Attesting Officer*

*Commissioner of Patents and Trademarks*